US011652314B2

(12) United States Patent
Gunreben et al.

(10) Patent No.: US 11,652,314 B2
(45) Date of Patent: May 16, 2023

(54) SEALED ELECTRICAL CONNECTOR

(71) Applicant: Aptiv Technologies Limited, St. Michael (BB)

(72) Inventors: Michael Gunreben, Schwanstetten (DE); Bruno Barth, Fürth (DE)

(73) Assignee: APTIV TECHNOLOGIES LIMITED

( * ) Notice: Subject to any disclaimer, the term of this patent is extended or adjusted under 35 U.S.C. 154(b) by 0 days.

(21) Appl. No.: 17/191,185

(22) Filed: Mar. 3, 2021

(65) Prior Publication Data

US 2022/0311174 A1 Sep. 29, 2022

(30) Foreign Application Priority Data

Mar. 27, 2020 (EP) ..... 20166439

(51) Int. Cl.
*H01R 13/627* (2006.01)
*H01R 13/52* (2006.01)

(52) U.S. Cl.
CPC ..... *H01R 13/5202* (2013.01); *H01R 2201/26* (2013.01)

(58) Field of Classification Search
CPC ..... H01R 13/6271; H01R 13/6275; H01R 13/6582; H01R 13/5202; H01R 13/5205
See application file for complete search history.

(56) References Cited

U.S. PATENT DOCUMENTS 5,114,359 A * 5/1992 Chishima ..... H01R 13/5221 439/271
5,145,356 A * 9/1992 Minnis ..... H01R 13/629 439/372
5,782,657 A * 7/1998 Wolla ..... H01R 13/5221 439/595
5,830,002 A * 11/1998 Ito ..... H01R 13/6272 439/358
6,024,595 A * 2/2000 Saba ..... H01R 13/641 439/352

(Continued)

FOREIGN PATENT DOCUMENTS

EP 1160929 B1 2/2005
EP 1727242 A2 11/2006

(Continued)

*Primary Examiner* — Thanh Tam T Le
(74) *Attorney, Agent, or Firm* — Billion & Armitage

(57) ABSTRACT

A sealed electrical connector assembly includes a first and second connector member. The first connector member is arrangeable in open and sealed positions. In the sealed position, the first connector member is mated and sealed to the second connector member. The first and second connector member sealing walls face each other in a sealing region. The first and second connector members includes first and second connector member sealing walls extending essentially the same direction. In the sealed position, a flexible sealing element is configured to be arranged between and contacting the first and second connector member sealing walls in the sealing region. The flexible sealing element is fixed with respect to one of the sealing walls and is releasably engageable with another one of the sealing walls for providing a watertight seal. The sealing wall is slanted with respect to the first direction along an entire sealing region.

16 Claims, 9 Drawing Sheets

(56) References Cited

U.S. PATENT DOCUMENTS 6,045,404 A * 4/2000 Myer ..... H01R 13/4223 439/595
6,053,753 A * 4/2000 Kunkle ..... H01R 13/5221 439/275
6,116,953 A * 9/2000 Myer ..... H01R 13/4364 439/595
6,443,764 B2 * 9/2002 Makita ..... H01R 13/5219 439/271
6,659,789 B2 * 12/2003 Nagamine ..... H01R 13/639 439/352
6,918,783 B2 * 7/2005 Endo ..... H01R 13/641 439/352
7,029,328 B1 * 4/2006 Mckenzie ..... H01R 13/5221 439/587
7,131,854 B1 * 11/2006 Pavlovic ..... H01R 13/633 439/352
7,351,102 B2 * 4/2008 Cykon ..... H01R 13/4368 439/587
7,997,940 B2 8/2011 Regnier
8,968,021 B1 * 3/2015 Kennedy ..... H01R 13/641 439/352
9,337,571 B2 5/2016 Furuya et al.
9,685,731 B2 6/2017 Chonan
9,941,636 B2 * 4/2018 Jodon De Villeroche ..... H01R 13/639
10,476,201 B2 * 11/2019 Siwek ..... H01R 13/506
10,637,188 B2 * 4/2020 Schmidt ..... H01R 43/26
10,811,820 B2 * 10/2020 Ohfuku ..... H01R 13/641

FOREIGN PATENT DOCUMENTS

EP 1891707 B1 9/2010
JP 2011204368 A 10/2011
JP 2012186075 A 9/2012
JP 5417800 B2 11/2013
JP 2015201331 A 11/2015

* cited by examiner

SEALED ELECTRICAL CONNECTOR

CROSS-REFERENCE TO RELATED APPLICATION

This application claims benefit of priority to European Patent Application No. 20166439.8 filed in the European Patent Office on Mar. 27, 2020, the entire disclosure of which is hereby incorporated by reference.

TECHNICAL FIELD OF THE INVENTION

The invention relates to the field of sealed electrical connector assemblies and in particular to supplemental restraint system (SRS) plug connectors or airbag squib connectors. The invention further relates to a corresponding method for coupling an electrical connector assembly. An electrical connector assembly according to the invention is typically used in vehicles, particularly in the vehicle electrical system.

BACKGROUND

Electrical connector systems are used for joining electrical circuits, wherein typically a male contact terminal is mated with a female contact terminal. In vehicles, such as cars, multiple electrically driven supplemental restraint systems (SRS) are needed to ensure an optimal interplay of safety components (e.g., between the airbag and the pretensioner of the safety belt) in an event of an accident.

A failure of SRS components may lead to severe consequences for road users involved in an accident, and it is accordingly strived to provide the electrical connector systems such that it can be ensured that they work in a reliable and error-free manner. Since electrical connectors in vehicles often have small dimensions, so called connector position assurance (CPA) members are often provided, which can aid a user to ensure a proper alignment of any parts of the electrical connector. Even further it is desirable that the electrical connection established by respective connectors are protected from any disadvantageous environmental impacts, such as debris and moisture. Several approaches are known in the prior art to provide sealed connector assemblies.

U.S. Pat. No. 7,997,940 B2 discloses an electrical connector assembly for an airbag ignitor, wherein a plug member further includes an annular gasket seal around a plug nose and under a plug body, said seal being configured to seal the gap between a socket member and a plug member when the plug member is inserted into the socket member aperture.

U.S. Pat. No. 9,337,571 B2 discloses a sealing member, configured to be installed to an outer peripheral surface of a first connector housing among a pair of connector housings so as to seal a gap between the outer peripheral surface of the first connector housing and an inner peripheral surface of a second connector housing among the pair of the connector housings. An inner peripheral surface of the sealing member is formed with protrusions and grooves which are aligned with a first wavelength in an axial direction of the sealing member, an outer peripheral surface of the sealing member is formed with protrusions and grooves which are aligned with a second wavelength in the axial direction. The first wavelength is equal to or smaller than the second wavelength, and positions of the protrusions of the inner peripheral surface are shifted from positions of the protrusions of the outer peripheral surface in the axial direction.

According to the approaches of the prior art, relatively high forces must be applied by a user to mate, close and/or seal the respective electrical connectors. Further, in the approaches according to the prior art, a user closing the electrical connector by a pushing movement often experiences irregular forces when flexible seals are employed due to the additional frictional and compressive forces.

SUMMARY

A sealed electrical connector assembly is presented herein. The sealed electrical connector assembly includes a first connector member and a second connector member, wherein the first connector member is configured to be arrangeable in an open position and a sealed position, wherein, in the sealed position. The first connector member is fully mated and sealed with the second connector member. The first connector member includes a first connector member sealing wall extending essentially in a first direction, and wherein the second connector member includes a second connector member sealing wall extending essentially in the first direction, wherein in a sealed position, the first connector member sealing wall and the second connector member sealing wall face each other in a sealing region, a flexible sealing element, wherein, in the sealed position, the flexible sealing element is configured to be arranged between and contacting the sealing walls of the first connector member and the second connector member in the sealing region, wherein the flexible sealing element is fixed with respect to one of the sealing walls and configured to be releasably engageable with another one of the sealing walls for providing a watertight seal, wherein the sealing wall for releasably engaging the flexible sealing element is slanted with respect to the first direction along an entire sealing region.

Thus, a sealed electrical connector assembly can be obtained which protects in a sealed position housed parts from any undesired environmental impacts such as debris and moisture while employing a low seal mating force. A sealed electrical connector assembly according to the present invention may include any suitable connector assembly known in the art such as for example sealed connectors including connector position assurance (CPA) and/or terminal position assurance (TPA) members, sealed connectors couples for instance formed by male and female connectors, which can be for instance directly mated, e.g. by a latch, or which may include a mating assistance such as a lever or slider. The sealed electrical connector assembly may allow to obtain a water resistance value sufficient to obtain a protection from ingressing moisture. The plug connector may be a male or a female connector, including at least one, typically at least two electrical elements, for electrically connecting electrical components, such as electrical components of a vehicle electrical system. If there are more than two electrical contacts the connector may be used additionally for signaling purposes. The electrical elements may be an electrical consumer, a power source, a cable and/or a cable harness.

The first connector member and/or the second connector member may be formed as one integral part, for instance by a molding process, or may be formed by multiple parts which are assembled together. The second connector member and the first connector member may be formed in a circular manner, such that the first connector member could be received in a circular aperture of the second connector member. Accordingly, the non-slanted sealing wall may be in the form of a cylinder and the slanted sealing wall may be in the form of a cone. Even further, both sealing walls may be formed in a slanted manner. Accordingly, the flexible sealing element may be in the form of a circular ring which may be fixed to the non-slanted sealing wall. Thus, the flexible sealing element may be provided in form of a mounted seal ring, which may be accordingly fixed or mounted by tension and/or friction with the non-slanted sealing wall. The sealing element may include any suitable flexible material, which allowing a respective sealing function when compressed. Nonlimiting examples may include elastomers such as thermoset elastomers for example rubber and silicone. Further examples may include thermoplastic elastomers and urethanes. The shape and size of the flexible sealing element may be suitably configured such that a smooth movement of the first connector member or any other counterpart relative to the second connector member is provided when the flexible sealing element is compressed during a sealing movement, which also may be referred to as a mating or closing movement. The respective parts may be preassembled such that the preassembled plug connector already includes the first connector member in an open position, which is then mated with a corresponding counter-connector. The open position of the first connector member is to be understood as a position, wherein no sealing functionality is provided. Ever further, also the flexible sealing element may be provided with the second connector member or the first connector member in a preassembled manner. The flexible sealing element may include any suitable form that allows a proper compression during an engagement such as one or more bulges or lips. The sealing wall may be slanted in a way that a constant inclination angle is provided in the first direction, which also may be referred to as the closing or mating direction and the form of the flexible sealing element may be configured to this inclination to allow a preferably constant and homogenous force build-up during the sealing movement of the first connector member without any undesired intermediate force peaks which may mislead a user to the assumption that the first connector member is already arranged in a sealed position, which also may be referred to as a mated or closed position. Even further, the elements of the sealed electrical connector assembly according to the present invention prevents the need for high pushing forces when the first connector member is moved by a user into its sealed position, which may allow a user to obtain a quicker and less tiring establishment of respective electrical connections. Accordingly, the sealed electrical connector assembly according to the present invention may be particularly reliable. The slanted sealing wall may also include a lead-in chamfer that facilitates the correct initial positioning of the flexible sealing element with the slanted sealing wall. Thus, a sealed electrical connector assembly may be obtained, which allows overcoming negative impacts such as one or more undesired force peaks originating mainly from normal force components that work axially against the first direction. Even further, additional friction caused by the flexible sealing element may be reduced. Thus, the assembly according to the present invention allows avoiding counteracting forces occurring in the axial direction but also in the radial direction.

In a preferred embodiment, the flexible sealing element includes at least two compressible lips extending towards the slanted sealing wall, wherein the at least two compressible lips are configured such that a compression for the at least two compressible lips is essentially the same in the sealed position.

Accordingly, a homogenous force distribution across the flexible sealing element can be obtained. This avoids a one-sided load of only one lip, which may cause damage and/or malfunctioning. This may of course also apply to a higher number of lips such that the respective force accordingly distributes homogenously across the lips. Also, the compressible lips may be formed in a way that an engagement of the compressible lips with the slanted sealing wall is configured such that force peaks due to deformation of said lips may be prevented. The provision of suitably formed compressible lips, which are configured in form and/or material with regard to a respective optimized contact and compression with a slanted sealing wall allows to configure a respective deformation of the lip and a frictional contact force which may occur when a lip contacts the respective sealing wall. The size of the lips may be accordingly configured to the slanted sealing wall surface and may be for instance different for each lip such that the pressure on the surface of the slanted sealing wall in the sealed condition, which may be referred to as a closed or mated condition, is the same for each lip.

In a preferred embodiment, an angle of the slanted sealing wall is 1 to 20°, preferably 3 to 15° and most preferred 5 to 10°.

The angle, which may also be referred to as inclination angle, is provided relative to the first direction of the first connector member, which may be along a vertical axis. This inclination angle may be constant along the entire slanted sealing wall. Thus, variations of resulting forces may be prevented when the first connector member is moved from the open position to the sealed position. The surface inclination of the flexible sealing element may be accordingly configured to provide sufficient contact with the slanted sealing wall to safeguard sealing functionality. The selection of the slant angle being larger or smaller may be chosen dependent on the need for a low mating force (small angle), a short necessary travel distance (larger angle), sufficient lip compression (larger angle) and a low tendency of the first connector member or other parts to unintendedly move against the first direction (small angle).

In a preferred embodiment, the flexible sealing element is fixed with respect to the second connector member sealing wall, and configured to be releasably engageable with the first connector member sealing wall.

This may allow for a preassembly of the flexible sealing element with the second connector member. Thus, the second connector member and the sealing element may be provided as one preassembled element, and the first connector member may be subsequently inserted in respective apertures of the second connector member. In further embodiments according to the present invention, the flexible sealing element may be provided in a preassembled manner with the first connector member, which forms accordingly a preassembled element, which may subsequently be inserted in respective apertures of the second connector member. This may facilitate assembly of the sealed electrical connector assembly according to the present invention.

In a preferred embodiment, the contact between the flexible sealing element and the slanted sealing wall is formed such that a compressive sealing reaction force against the first direction is essentially constantly increasing when the first connector member is moved from the open to the sealed position.

Thus, any undesired force peaks, which may be experienced by a user pushing the first connector member into its sealed position could be prevented. Further, a constantly increasing force may allow a connector assembly, wherein it is easier to estimate respective compensation forces that may be desired and accordingly provided by respective means to compensate the compressive sealing reaction force. The avoidance of force peaks may also prevent damage and wear of the parts encountering said force. Within this specification, reaction force is meant to be the force which a user may experience when pushing the first connector member into the sealed position. Thus, the compressive sealing reaction force should be understood as the force experienced by a user due to the compression of the flexible sealing element and its respective friction with the second connector member sealing wall and the first connector member sealing wall.

In a preferred embodiment, the first connector member further includes at least one force feedback element, and wherein the second connector member includes a second connector member housing, wherein the second connector member housing includes at least one force feedback counter element configured to engage the at least one force feedback element when moving the first connector member towards the sealed position. An engagement between the at least one force feedback element and the at least one force feedback counter element is formed such that a force feedback can be provided to a user when the first connector member is moved to the sealed position.

Accordingly, a user may unambiguously derive from the force feedback experienced during mating and/or closing, when the first connector member is arranged in a fully sealed position. Thus, intermediate force peaks can be avoided and any intermediate first connector member positions, which may lead to an incomplete first connector member positioning and thus to an incomplete sealing of the connector assembly may be prevented. This improves reliability of the sealing during mating and/or closing. Even further the compressive sealing reaction force acting on the first connector member against the first direction may be at least partly compensated.

Compensation of a reaction force is to be understood such that the force, which must be applied by a user to overcome the frictional force and the compressive force of the sealing element, is compensated. Accordingly, when a high compressive force of the flexible sealing element is present, this would result in a high respective reaction force. However, although the compressive force may even further increase when moving the first connector member towards its sealed position, as the flexible sealing element is compressed further, a user may be facilitated to overcome this reaction force and may be facilitated to push the first connector member further in the first direction. Thus, the extra force which may be caused by the flexible sealing element may be compensated. The force feedback element(s) and the corresponding force feedback counter element(s) may be formed from any suitable flexible material, such as plastic. The above noted force feedback configuration may be provided as a separate locking means or in addition to further locking means, such as for instance traditional locking latches that may be provided between corresponding male and female housings. Even further, the arrangement may be configured such that two symmetrical flexible members would work symmetrically against a central "rigid" member. In this case, the "rigid" member would be loaded symmetrically, and thus would not need additional support or guiding force. This would lead to a reduction of friction.

In a preferred embodiment, the first connector member is configured to be moveable about a first connector member closing path distance from the open position to the sealed position, wherein the at least one force feedback element and the at least one force feedback counter element are formed to allow that, in the last 10%, preferably in the last 20% of a first connector member closing path distance of the first connector member, a resulting reaction force acting on the first connector member becomes minimum. In a preferred embodiment, the first connector member closing path distance of the first connector member from the open position towards the sealed position is up to 20 mm, preferably up to 10 mm, more preferably up to 5 mm and most preferably up to 2.6 or 2.7 mm.

Thus, the force level of the force feedback elements may advantageously reduce or cancel out the force level due to the seal, which can occur due to on compression and friction, at the end of the first connector member movement. According to the present invention, the force feedback may be provided such that a big force difference between a maximum positive force value at a beginning of a closing movement and a minimum force value at the end of the movement, which can still be a positive force value, can be obtained. Thus, a strong force decrease during the movement can be achieved, which leads to an improved force feedback. In a further preferred embodiment, a resulting reaction force acting on the first connector member becomes negative such that the first connector member is urged towards the sealed position. Accordingly, a user may be facilitated in completing the sealing movement of the first connector member. It is to be understood that a reaction force experienced by a user which acts against his or her pushing force may be denoted with a positive sign. Thus, if the reaction force is negative, it is to be understood that a force acts in a direction such that the first connector member is urged towards its sealed position without the need of a further pushing by a user. Thus, the first connector member may snap automatically into its sealed position and a misalignment in an intermediate position may be prevented. As an example, if the first connector member has to be moved for a total distance of 10 mm from an open position towards a sealed position, the first connector member may snap for instance at the last 20% of a total distance, which corresponds to 2 mm, into the sealed position. That is the first connector member travels the last 2 mm towards the sealed position with no further force applied from a user. Of course, also other absolute or relative first connector member closing path distance values may be employed, as desired.

In a preferred embodiment, the at least one force feedback element of the first connector member is a rigid member extending in the first direction, wherein the rigid member includes a bulge provided at a central portion of the rigid member, wherein the bulge protrudes towards the at least one force feedback counter element. The at least one force feedback counter element is a flexible locking member extending against the first direction and including a contact head arranged at a distal end of the flexible locking member, wherein the contact head protrudes towards the at least one force feedback element. It should be understood that the flexible locking member may also be oriented in a different direction than the first direction, as long as a suitable interaction between the flexible locking member and a respectively formed counterpart can be enabled. For instance, the flexible locking member may be formed as a horizontally oriented arm. In a preferred embodiment, when the first connector member is moved from the open to the sealed position in the first direction, the flexible locking member is configured to:

a. initially engage the bulge of the rigid member with the contact head at a contact portion,
b. deflect due to the engagement with the bulge while the movement continues, and
c. flexibly return to its initial position after the contact portion has passed a maximum protruding width of the bulge, wherein the deflected contact head urges the bulge in the first direction towards the sealed position.

Accordingly, respective forces may be applied to the first connector member, which may allow for the above noted snapping functionality. The contact portion is understood as the region where contact between the bulge and the contact head occurs. Of course, also the above noted configuration may be provided vice-versa such that the force feedback element(s) of the first connector member may be provided as one or more flexible member(s) and the force feedback counter element(s) of the second connector member housing may be provided as one or more rigid member(s) or both parts may be provided as flexible members, as long as a suitable force distribution can be provided that may allow for a force feedback and/or compensation during the sealing movement of the first connector member. As the skilled person appreciates, the amount of "rigidity" and "flexibility" of the two members may be of course dependent for instance on the materials and the sizes and shapes of the respective members. That is, the rigid member may also be allowed to slightly deflect to some extent. However, the flexible member will be understood as the member that deflects to a larger extent compared to the deflection of the rigid member during engagement of the two members. The bulge and the contact head may also be provided at other suitable portions of the force feedback element(s) of the first connector member or the force feedback counter element(s) of the second connector member, respectively.

In a preferred embodiment, the electrical connector assembly is configured to provide a haptic feedback to a user pushing the first connector member towards the sealed position when the first connector member has reached its sealed position.

Thus, a user may unambiguously distinguish if the first connector member has reached its final sealed position. Accordingly, a misalignment of any parts of the sealed electrical connector assembly according to the present invention due to an incomplete first connector member positioning may be prevented. This feedback may also be instead of or in addition to any further suitable indications, such as a visual indication or acoustic indication such as a clicking sound when the first connector member has reached its sealed position. The haptic feedback may also be different to a "click" effect when the final position is reached. The haptic feedback may accordingly be a sudden drop of force after a steep raise, which may occur before the first connector member reaches its final position. Such behavior may provide a certain inertia effect, which allows avoiding an incomplete mating position.

In a preferred embodiment, one of the connector members is a plug connector, preferably an SRS plug connector or an airbag squib connector. Such kind of connectors are currently used for instance in airbag systems of cars. However, the present invention is not limited to this application but may be employed in any suitable electrical connector application.

In a preferred embodiment, an engagement between the first connector member, the flexible sealing element and the second connector member housing is formed such that a resulting reaction force acting on the first connector member, when the first connector member is moved from an open position to a sealed position along a first direction:

a. assumes positive values in the beginning of the first connector member movement such that the resulting reaction force acts in a direction against the first direction,
b. continuously increases until the resulting reaction force reaches a single maximum value, and then
c. continuously decreases until the resulting reaction force assumes a minimum value in the sealed position.

Thus, a steep force increase may be provided at the beginning of the movement with a maximum value, which may be between one third to one half of the movement before a constant decrease of the force to the end of the movement may be obtained. According to the present invention, the minimum force value in step c.) may remain positive at the end of the movement. This may occur for instance due to high friction or disadvantageous space constraints. According to the present invention the engagement of the first connector member and the second connector member may be configured such that a big force difference between the single maximum force value of step b.) and the minimum force value at the end of the movement in step c) may be obtained. Thus, a strong force decrease during the movement can be achieved, which leads to an improved force feedback. In a preferred embodiment the reaction force in step c.) assumes negative values such that the resulting reaction force acts in a direction towards the first direction urging the first connector member into the sealed position. Thus, the force may advantageously become negative at the end of the movement so as to close the last few fractions of the distance on its own, as already discussed above. A high maximum force value may be important to give a stronger feedback to a user and to make use of inertia effects in order to ensure a complete closing operation. In general, force variations may occur because of any tolerances of components especially in a multi cavity mold. These force variations may impair an unambiguous haptic feedback to a user, which however could be avoided by the sealed electrical connector assembly according to the present invention.

In a preferred embodiment, the sealing wall for releasably engaging the flexible sealing element is slanted with respect to the first direction along the entire sealing region such that width of the sealing wall for releasably engaging the flexible sealing element continuously decreases along the first direction.

Thus, any variations in the reaction forces due to different slant angles may be prevented which may further improve the sealing functionality, reliability of the sealed electrical connector assembly and the ability to provide an improved and unambiguous haptic user feedback which is free from any undesired force peaks.

In a preferred embodiment, the first connector member is a connector position assurance, CPA, member, the second connector member is a plug connector and the first direction is a CPA member closing direction.

The CPA member may thus ensure for a proper alignment of the respective mechanical and/or electrical parts of the electrical connector according to the present invention and may be configured to interrupt an electrical connection between a respective plug connector and a respective counter-connector as long as the CPA member is not placed in a properly sealed position. This facilitates a user to verify a proper alignment of the respective mechanical and electrical parts and a proper locking.

In a preferred embodiment, the first connector member is a counter-connector, the second connector member is a corresponding plug connector and the first direction is a connector assembly mating direction.

Thus, the above-described functionality of providing a watertight seal can be obtained between a plug connector and a corresponding counter-connector when mating the plug connector with a corresponding counter-connector.

In a further embodiment according to the present invention, a watertight seal may be provided between the CPA member and the plug connector when the CPA member is in the sealed position and a further watertight seal may be provided between the plug connector and the corresponding counter-connector when the plug connector is in the sealed position, wherein the respective watertight seals can be obtained as described above with regard to the above-described embodiments.

A skilled person will understand that the above noted preferred embodiments are described as mere examples and that the electrical connector assembly may of course include embodiments that can be a combination of the above noted features or include a different configuration than the embodiments described within this specification.

Further, the present invention particularly proposes a method for coupling an electrical connector assembly, including the steps of:

a. providing an electrical connector assembly according to one of the embodiments described above;
b. moving the first connector member from the open to the sealed position for providing an electrical connection and a watertight seal.

Thus, an employment of the electrical connector assembly according to the present invention may provide the above-described advantages.

BRIEF DESCRIPTION OF THE DRAWINGS

The present invention will now be described, by way of example with reference to the accompanying drawings, in which:

FIGS. 3A-3D schematically shows a flexible sealing element during a displacement of a connector position assurance (CPA) member of an electrical connector assembly according to the present invention;

DETAILED DESCRIPTION

Figure 1:
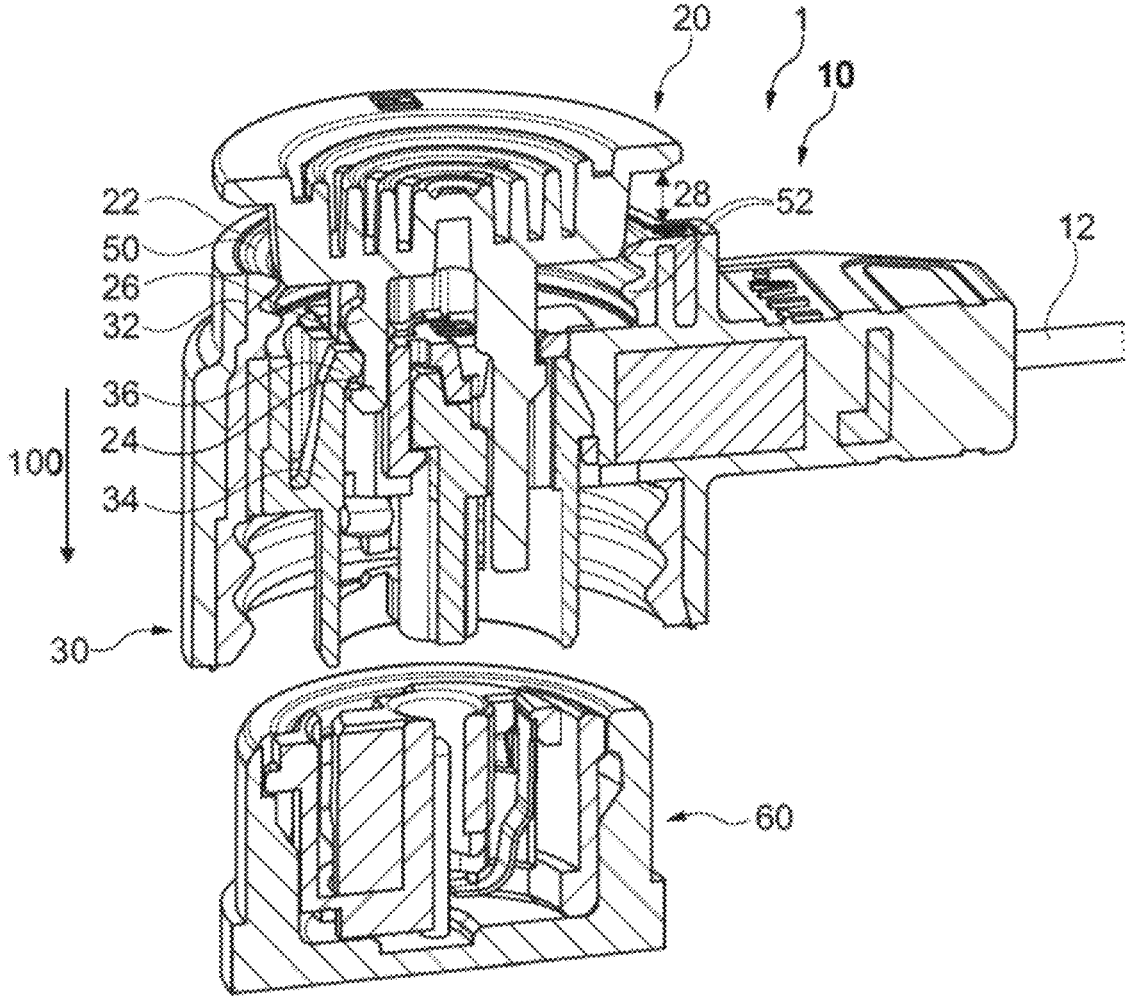
FIG. 1 schematically shows a cross sectional view of an electrical connector assembly according to the present invention, wherein the first connector member is a CPA member in an open position.

FIG. 1 shows a cross sectional view of an electrical connector assembly according to the present invention when the first connector member, which is shown as a connector position assurance (CPA) member 20 in an open position. A second connector member is shown as a plug connector 10, which is configured to mate with a corresponding counter-connector 60, which together form a sealed electrical connector assembly 1. The counter-connector 60 is shown in a disconnected state, whereas it should be understood that it may of course be provided being mated with the plug connector 10. The plug connector 10 includes a second connector member housing 30, which is shown as a connector housing 30, which encloses any further parts of the plug connector 10, such as electrical components. An electrical cable 12 is connected to the plug connector 10 and provides an electrical connection to further components which are connected to the sealed electrical connector assembly 1. The plug connector 10 further includes the CPA member 20, which is arranged to be received by the connector housing 30. In this embodiment, the CPA member 20 and the connector housing 30 are formed in a circular manner. The CPA member 20 is able to move along a first or closing direction 100 into a sealed position, whereas the connector housing 30 and its respective parts remain in a fixed position. The CPA member 20 includes a first connector member sealing wall 22, which is shown as a CPA member sealing wall 22 at its top side, which extends essentially along the closing direction 100. The CPA member sealing wall 22 is slightly slanted along the closing direction 100, such that it has a cone-shaped appearance. On the top side of the CPA member a pushing surface is provided, which allows a user to push the CPA member 20 in the closing direction 100 about a first connector member closing path distance 28, which is shown as a CPA member closing path distance 28 from an open to a sealed position. The slanted CPA member sealing wall 22 is received by a respective aperture on the top side of the connector housing 30, which has, in this embodiment, a circular appearance. The inner wall of the circular receiving aperture, which forms a second connector member sealing wall 32, which is shown as a connector housing sealing wall 32 is provided with a flexible sealing element 50 which includes two compressible lips 52, which are configured such that the slanted CPA member sealing wall 22 can slide along said compressible lips 52 when the CPA member 20 is pushed into the sealed position.

The CPA member 20 further includes inner parts which facilitate the mating and alignment of mechanical and electrical parts of the plug connector 10 and the counter-connector 60, such as a force feedback element 24. This force feedback element 24 extends from the top of the CPA member in the closing direction 100 towards the counter-connector 60 and has a bulge 26, which is configured to engage a respective contact head 36 of a force feedback counter element 34 of the connector housing 30. The connector housing 30 forms a respective chamber, in which the force feedback element 24 can move downwards in the closing direction 100, when the CPA member 20 is accordingly pushed.

Figure 2:
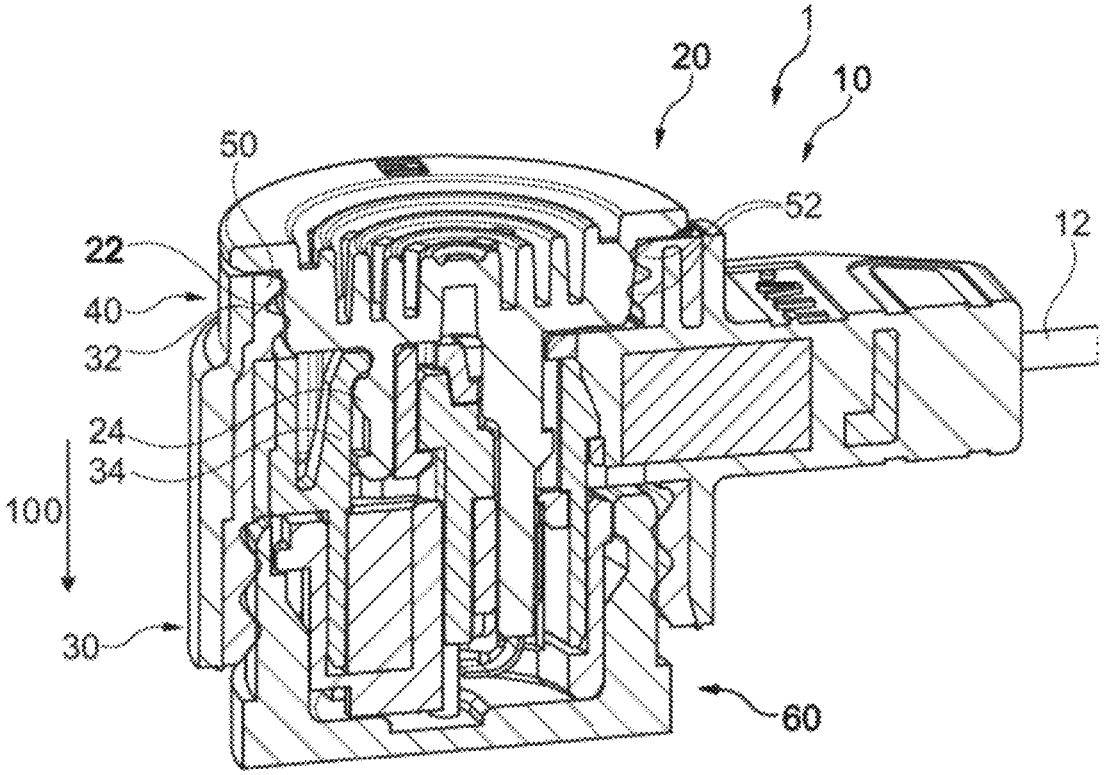
FIG. 2 schematically shows a cross sectional view of an electrical connector assembly according to the present invention wherein the first connector member is a CPA member in a sealed position.

FIG. 2 schematically shows a cross sectional view of the electrical connector assembly of FIG. 1 according to the present invention when the CPA member 20 is in a sealed position. Again, the counter-connector 60 is shown being connected to the plug connector 10 to establish an electrical connection. After the plug connector 10 and the counter-connector 60 have been mated, the CPA member 20 is brought into the sealed position, which allows the CPA member 20 to align any mechanical and electrical parts in the sealed electrical connector assembly 1 and thus allows to ensure a safe connection. As can be seen the CPA member 20 has been pushed towards the closing direction 100. The CPA member sealing wall 22 has been moved along the compressible lips 52, which are arranged and compressed in the sealing region 40, which is the region wherein the watertight seal between the CPA member sealing wall 22 and the connector housing sealing wall 32 is formed. The contact head 36 is latched behind the recess of the bulge 26.

Figure 3E:
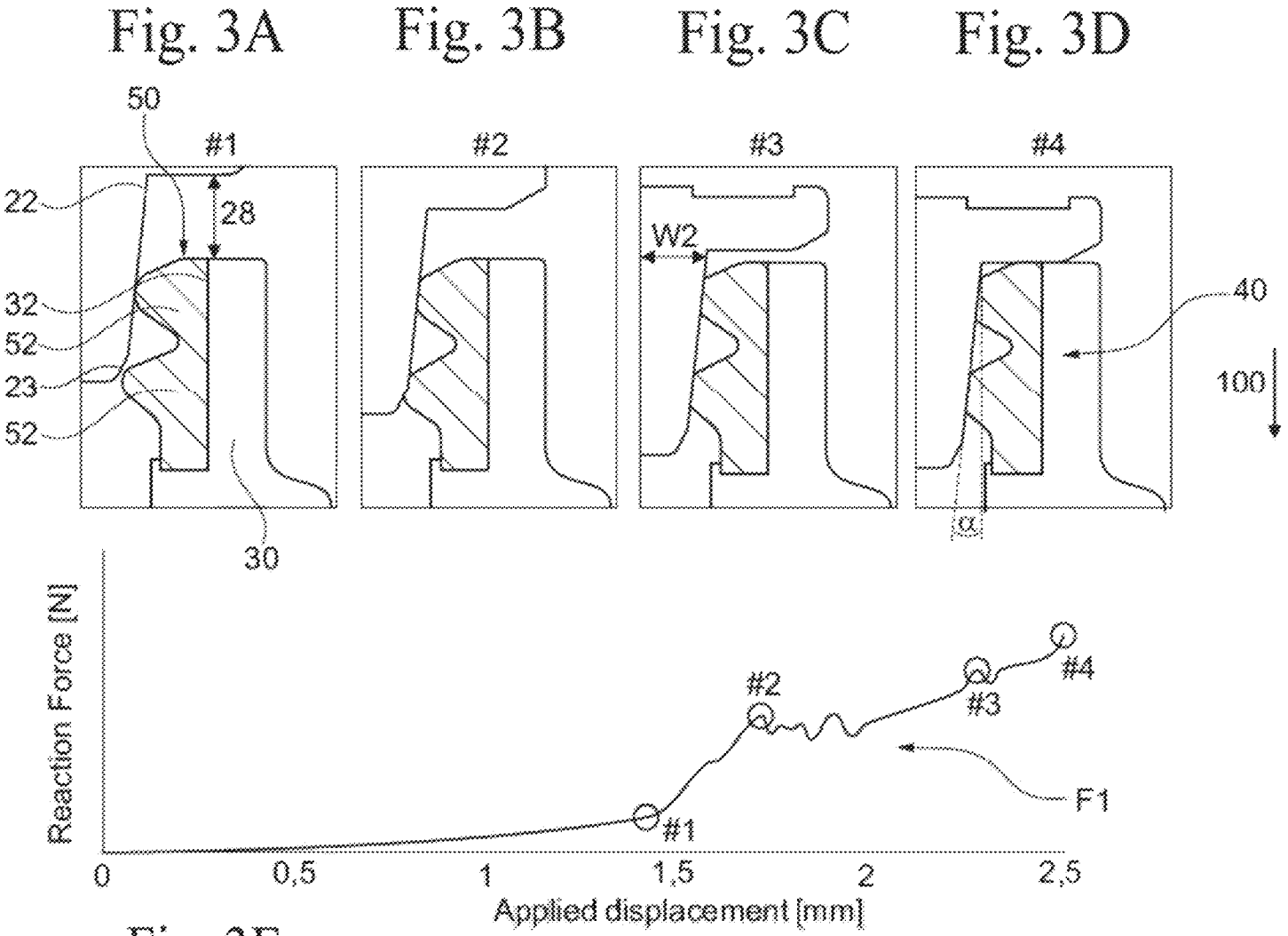
FIG. 3E schematically shows a reaction force originating from a flexible sealing element during a displacement of a CPA member in an electrical connector assembly according to the present invention.

FIGS. 3A-3D shows compressible lips 52 of the flexible sealing element 50 during a displacement of a CPA member 20 of a sealed electrical connector assembly 1 according to the present invention. The progress of movement is depicted in FIGS. 3A-3D, such that the CPA member 20 moves along the closing direction 100 and travels across the CPA member closing path distance 28 from FIGS. 3A-3D. The flexible sealing element 50 is fixed to the connector housing 30. FIG. 3E shows a corresponding force-path-diagram depicting the reaction force occurring during progression of the CPA member movement in the closing direction 100. The slanted CPA member sealing wall 22 decreases in width W2 along the closing direction 100, which is illustrated by an angle $\alpha$ in FIG. 3D, with respect to the closing direction 100, which is the vertical direction. The slanted CPA member sealing wall 22 includes a lead-in chamfer 23, which is slanted to facilitate a lead-in of the flexible sealing element 50. FIG. 3A shows the situation when the upper compressible lip of the compressible lips 52 is already in contact with the slanted CPA member sealing wall 22. However, the upper one of the compressible lips 52 was not engaged by the lead-in chamfer 23 but directly contacted the slanted CPA member sealing wall 22 when the CPA member 20 was pushed towards the closing direction 100. This is reflected by the corresponding reaction force diagram of FIG. 3B, wherein the compressive sealing reaction force F1 constantly rises as the upper lip is constantly further compressed. In FIG. 3B, the lower one of the compressible lips 52 only slightly contacts the CPA member sealing wall 22. FIG. 3D shows the CPA member 20 in a final and fully sealed position, wherein the flexible sealing element 50 is compressed in the sealing region 40 between the CPA member sealing wall 22 and connector housing sealing wall 32. The corresponding compressive sealing reaction force F1 is maximum in this position. As can be seen from FIG. 3E, no significant force peaks are provided by the engagement between the flexible sealing element 50 and the CPA member sealing wall 22 when the CPA member 20 is moved into the sealed position. The overall force level is relatively low, since the compressible lips 52 are accordingly formed to fit the slanted CPA member sealing wall 22. As shown, the compressible lips are not compressed to the maximum in the beginning of the movement. The main contact pressure is applied at the last third of the CPA member movement.

Figure 4:
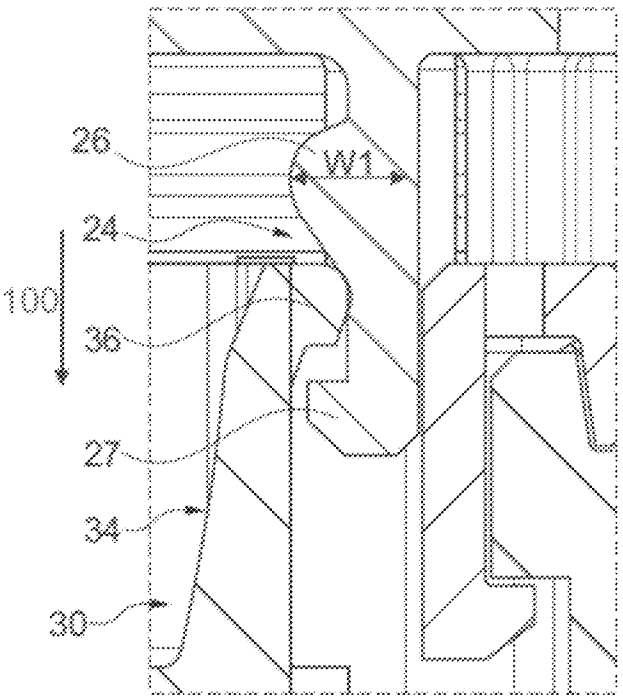
FIG. 4 schematically shows a cross sectional close-up view of a force feedback element and a force feedback counter element of an electrical connector assembly according to the present invention wherein a CPA member is in an open position.

FIG. 4 shows a cross sectional close-up view of a force feedback element 24 and a force feedback counter element 34, when the CPA member 20 is in an open position. As shown, the contact head 36 of a force feedback counter element 34 is formed by a connector housing 30. The contact head 36 is arranged between a latching protrusion 27 and a bulge 26 of a force feedback element 24, wherein the bulge 26 has a maximum protrusion width W1.

Figure 5:
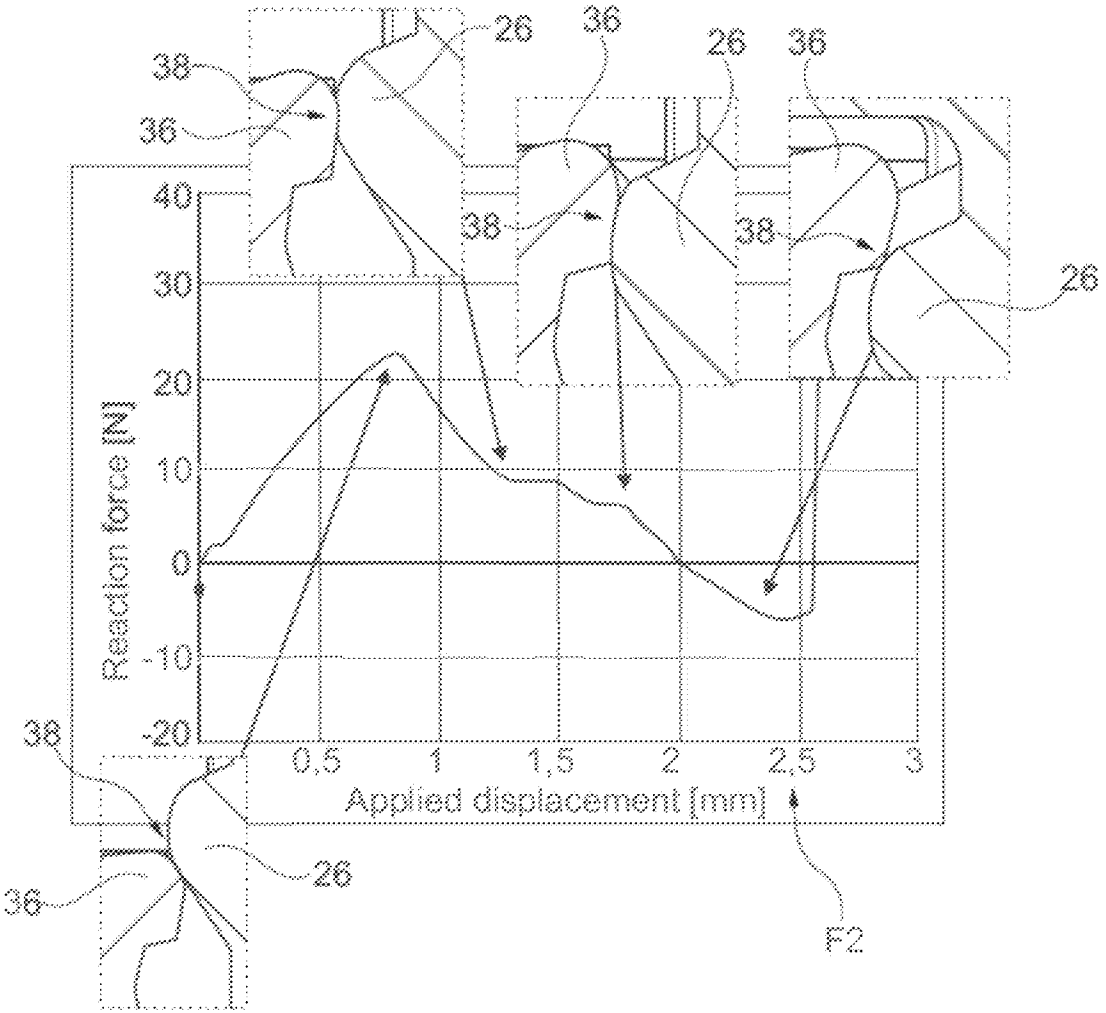
FIG. 5 schematically shows a reaction force and corresponding engagement positions of a force feedback element and a force feedback counter element of an electrical connector assembly according to the present invention.

As is further shown in FIG. 5, the contact head is configured to slide flexibly along the outer surface of the force feedback element 24 when the CPA member 20 is moved from an open to a sealed position along the closing direction 100. Respective positions of the bulge 26 of the force feedback element 24 and the contact head 36 of the force feedback counter element 34 during a closing movement are shown in the FIG. 5. The contact portion 38 is shown as the region where contact between the bulge 26 and the contact head 36 occurs. In the beginning of the movement, the contact head 36 is flexibly deflected by the rigid bulge 26. The reaction force from the force feedback element F2 of said engagement, which is shown in FIG. 5 accordingly increases and reaches a maximum value at around 0.8 mm displacement. At the end of the first ramp angle, when the radius to maximum width W1 starts, as shown in the leftmost portion of FIG. 5, the force starts decreasing. To avoid a further force increase when movement continues, the contact head 36 is provided with a backward angle on its front face which is non-vertical when relaxed and vertical when bent. After passing the maximum width W1 of the bulge 26, the force F2 further decreases until it gets negative, which means that the CPA member 20 no longer needs to be pushed in the closing direction 100 but the contact head 36 flexibly returns to its initial position such that it urges the bulge 26 in closing direction 100 until the CPA member 20 has reached its sealed position.

Figure 6:
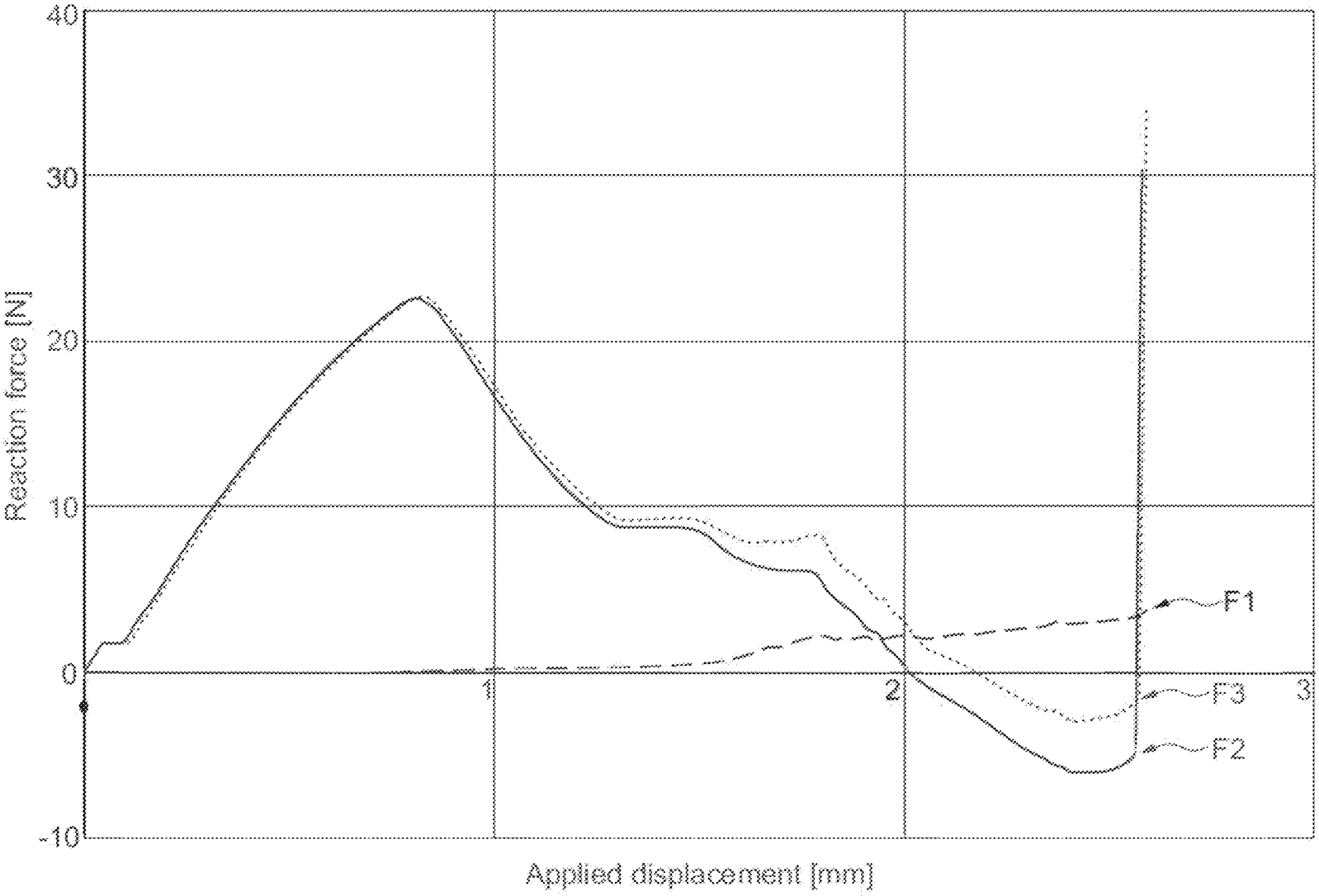
FIG. 6 schematically shows reaction forces originating from a flexible sealing element and a CPA member and a resulting total reaction force during a displacement of a CPA member in an electrical connector assembly according to the present invention.

FIG. 6 shows reaction forces F1 and F2 originating from the compression of a flexible sealing element 50 and from the engagement of a CPA member 20 with the connector housing 30, respectively, and a resulting total reaction force F3 along a displacement of a CPA member 20 in a sealed electrical connector assembly 1 according to the present invention. As can be seen, the resulting reaction force F3 is a sum of the compressive sealing reaction force F1 and the CPA member closing reaction force F2. As is apparent from the graph of the force F2, which originates from the engagement of the CPA member 20 with the connector housing 30, said force F2 partly compensates in the constantly increasing compressive sealing reaction force F1 originating from the compression and friction of the flexible sealing element 50 in the last half millimeter of displacement of the CPA member 20. Hence the resulting reaction force F3 becomes negative although force F1 increases. This allows that the CPA member 20 is urged towards its sealed position and no further pushing force must be applied by a user. As is apparent from graph F3, the interplay of the single components of the plug connector 10, namely the CPA member 20, the connector housing 30 and the flexible sealing element 50 allows to obtain a resulting force F3 with one maximum value around 0.8 mm of displacement and no further force peaks and negative force values at the end of the displacement. This accordingly allows a proper haptic feedback for a user, wherein he or she is able to unambiguously determine the state of the CPA member 20 movement and its state during closing movement.

Figure 7:
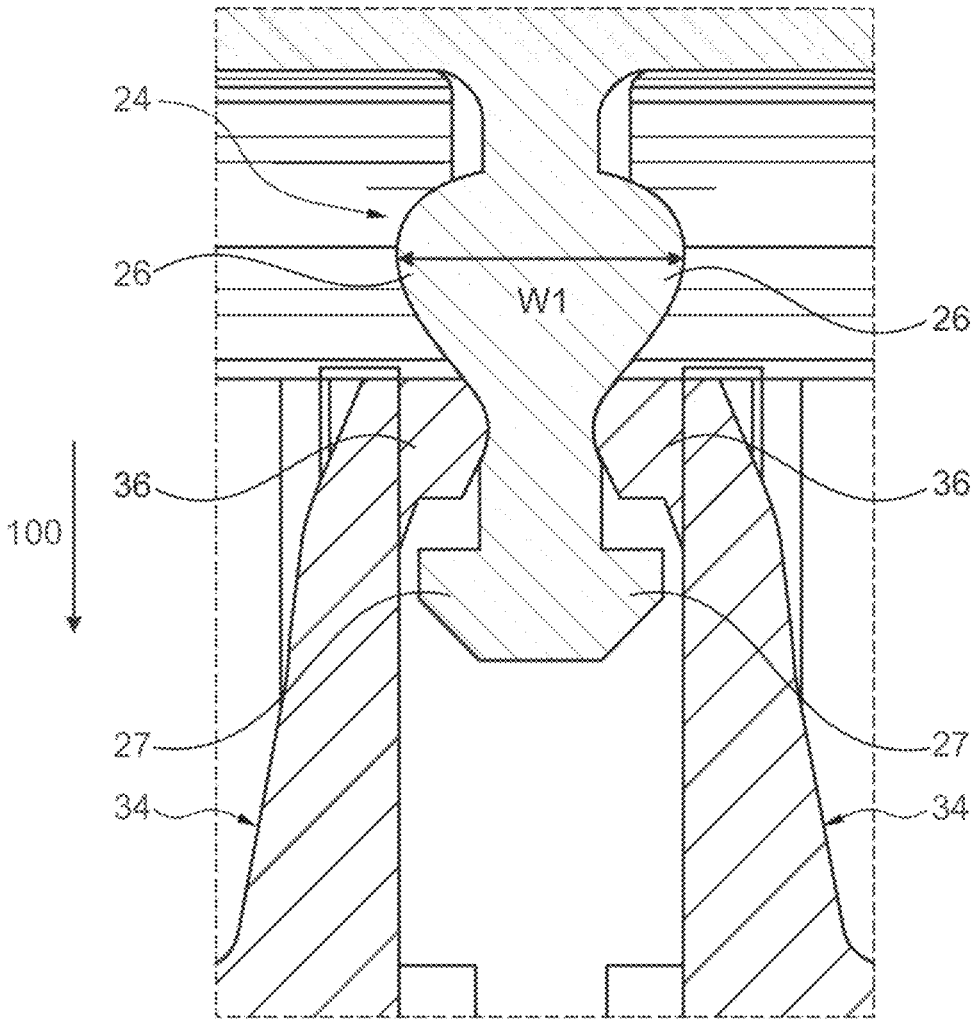
FIG. 7 schematically shows a cross sectional close-up view of a force feedback element and two force feedback counter elements of an electrical connector assembly according to the present invention wherein a CPA member is in an open position.

FIG. 7 shows a cross sectional close-up view of another embodiment of a force feedback configuration with a rigid force feedback element 24 and two flexible force feedback counter elements 34, when the CPA member 20 is in an open position. As shown, respective contact heads 36 of the two force feedback counter elements 34 are formed by a connector housing 30. The contact heads 36 are each arranged between the latching protrusions 27 and a respective side of the bulge 26 of the force feedback element 24, wherein the bulge 26 has a maximum protrusion width W1. The two symmetrical flexible force feedback counter elements 34 thus work symmetrically against the central rigid force feedback element 24 such that the rigid force feedback element 24 is loaded symmetrically.

Figure 8:
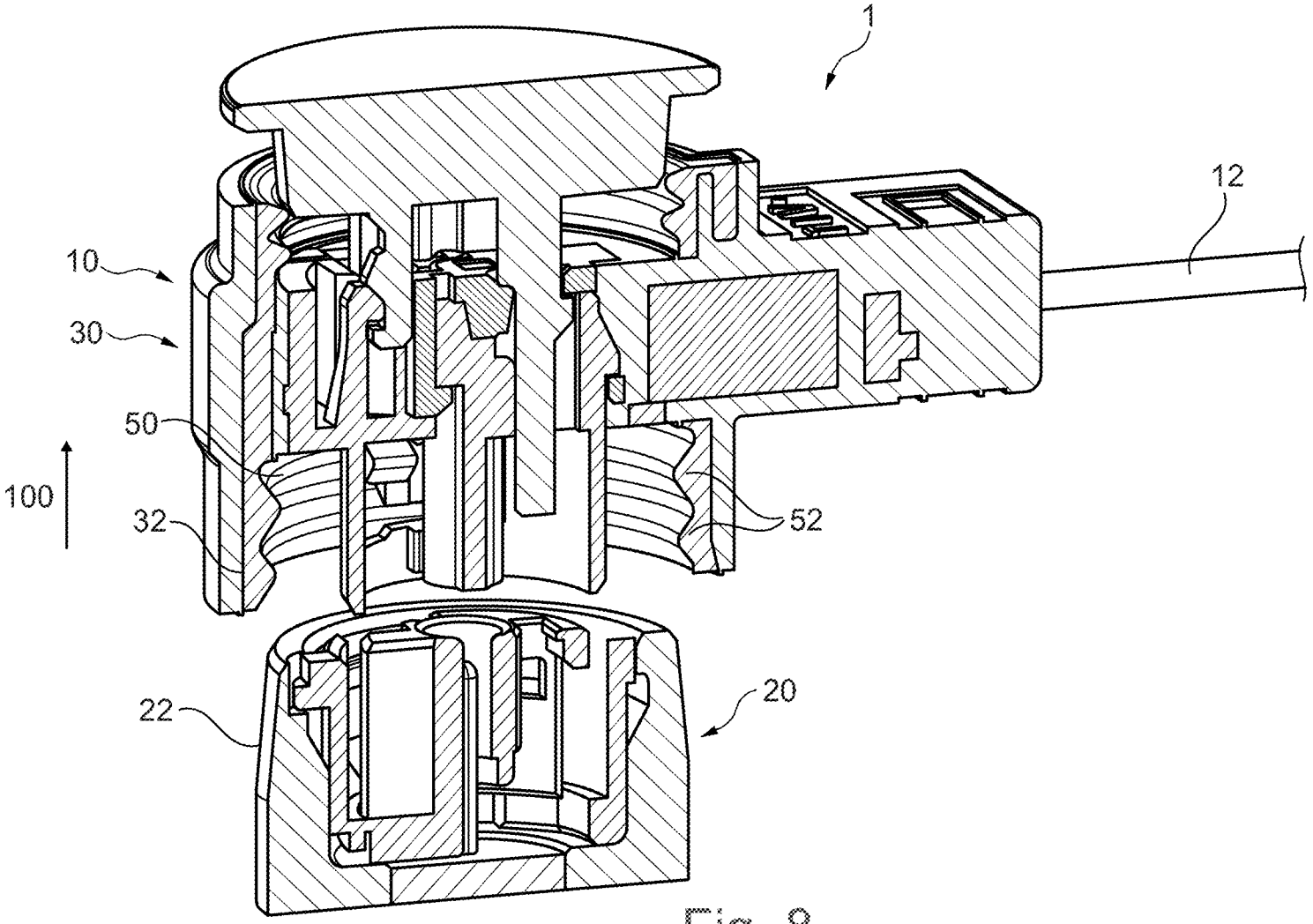
FIG. 8 schematically shows a cross sectional view of an electrical connector assembly according to another embodiment of the present invention, wherein the first connector member is a plug connector in an open position.

In particular, FIG. 8 shows a cross sectional view of another embodiment of the electrical connector assembly according to the present invention when the first connector member 20, which is shown as a counter-connector 20 is in an open or unmated position. A second connector member is shown as a plug connector 10, which is configured to mate with the corresponding counter-connector 20, which together form a sealed electrical connector assembly 1. The counter-connector 20 is shown in a disconnected state, whereas it should be understood that it may of course be provided being mated with the plug connector 10. The plug connector 10 includes a second connector member housing 30, which is shown as a connector housing 30, which encloses any further parts of the plug connector 10, such as electrical components. An electrical cable 12 is connected to the plug connector 10 and provides an electrical connection to further components which are connected to the sealed electrical connector assembly 1. The plug connector 10 further includes a CPA member. Both, the counter-connector 20 and the CPA member are arranged to be received by the connector housing 30. In this embodiment, the CPA member, the counter-connector 20 and the connector housing 30 are formed in a circular manner. The counter-connector 20 is able to move along a first or mating direction 100 into a sealed position, whereas the connector housing 30 and its respective parts remain in a fixed position. The counter-connector 20 includes a first connector member sealing wall 22, which is shown as a counter-connector sealing wall 22 at its top side, which extends essentially along the mating direction 100. The counter-connector sealing wall 22 is slightly slanted along the mating direction 100, such that it has a cone-shaped appearance. The slanted counter-connector sealing wall 22 is received by a respective aperture on the bottom side of the connector housing 30, which has, in this embodiment, a circular appearance. The inner wall of the circular receiving aperture, which forms a second connector member sealing wall 32, which is shown as a connector housing sealing wall 32 is provided with a flexible sealing element 50 which includes two compressible lips 52, which are configured such that the slanted counter-connector sealing wall 22 can slide along said compressible lips 52 when the counter-connector 20 is pushed into the sealed position.

Figure 9:
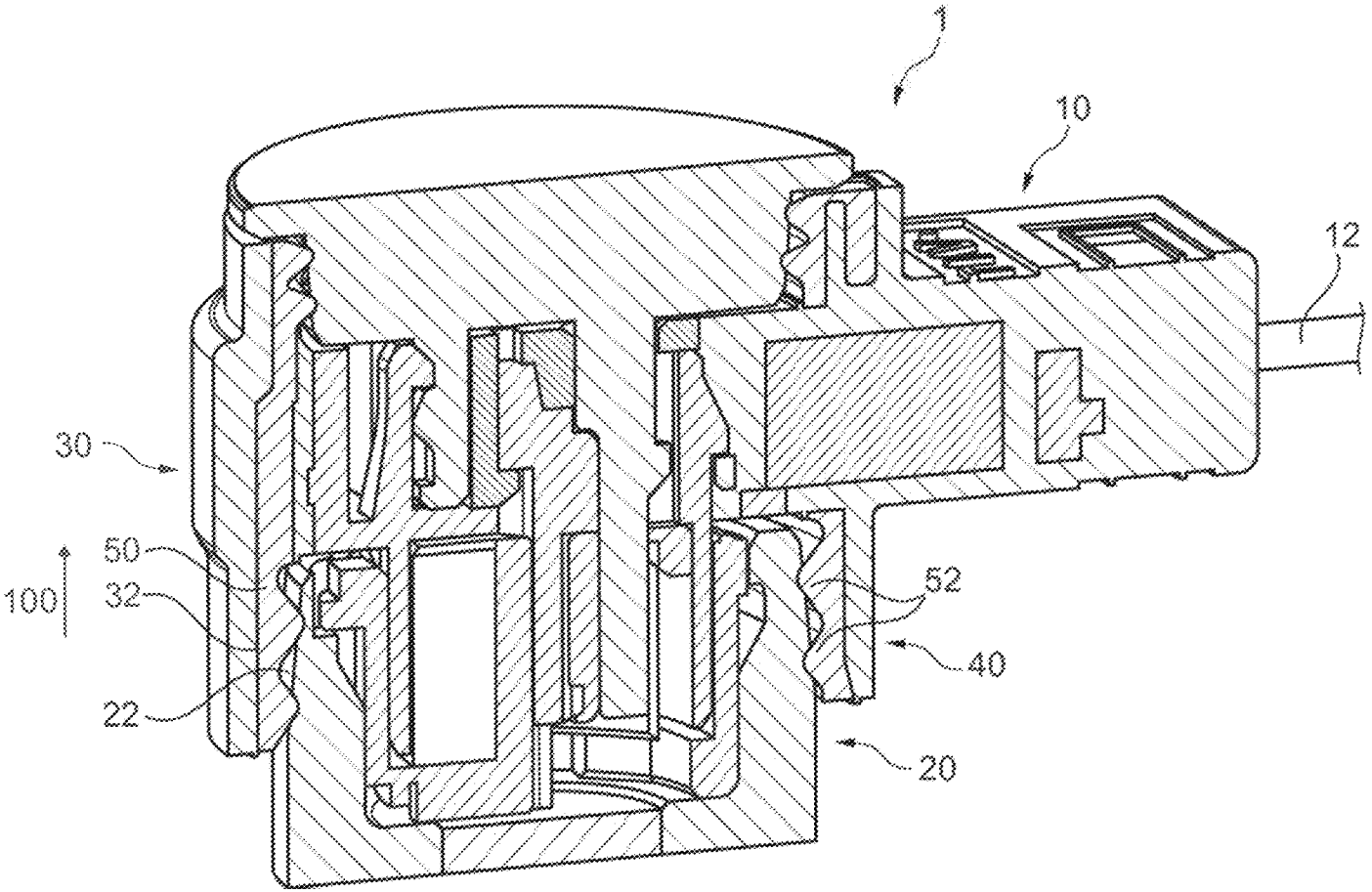
FIG. 9 schematically shows a cross sectional view of an electrical connector assembly according to another embodiment of the present invention wherein the first connector member is a plug connector in a sealed position.

FIG. 9 schematically shows a cross sectional view of the electrical connector assembly of FIG. 8 according to the present invention when the counter-connector 20 is in a sealed position. Again, the counter-connector is shown being connected to the plug connector 10 to establish an electrical connection. After the plug connector 10 and the counter-connector have been mated, the counter-connector 20 is brought into the sealed position, which allows the counter-connector 20 to allow a safe electrical connection. As can be seen, the counter-connector 20 has been pushed towards the mating direction 100. The counter-connector sealing wall 22 has been moved along the compressible lips 52, which are arranged and compressed in the sealing region 40, which is the region wherein the watertight seal between the counter-connector sealing wall 22 and the connector housing sealing wall 32 is formed.

Figure 10C:
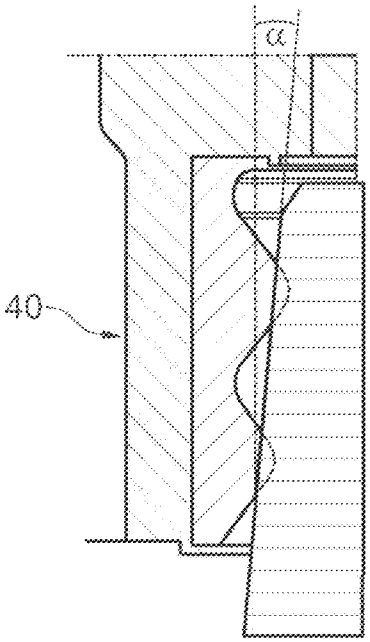
FIGS. 10A-10C schematically show a flexible sealing element during a displacement of a plug connector of another embodiment of an electrical connector assembly according to the present invention.
Figure 10B:
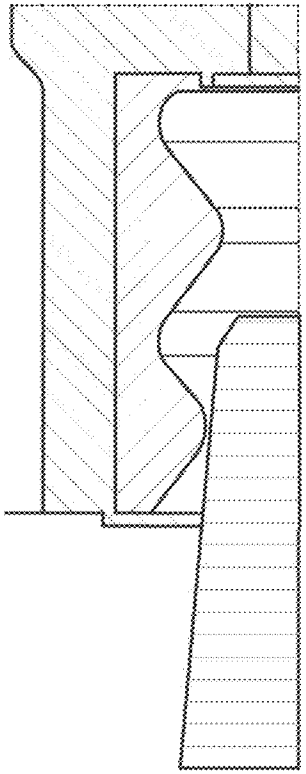
Figure 10A:
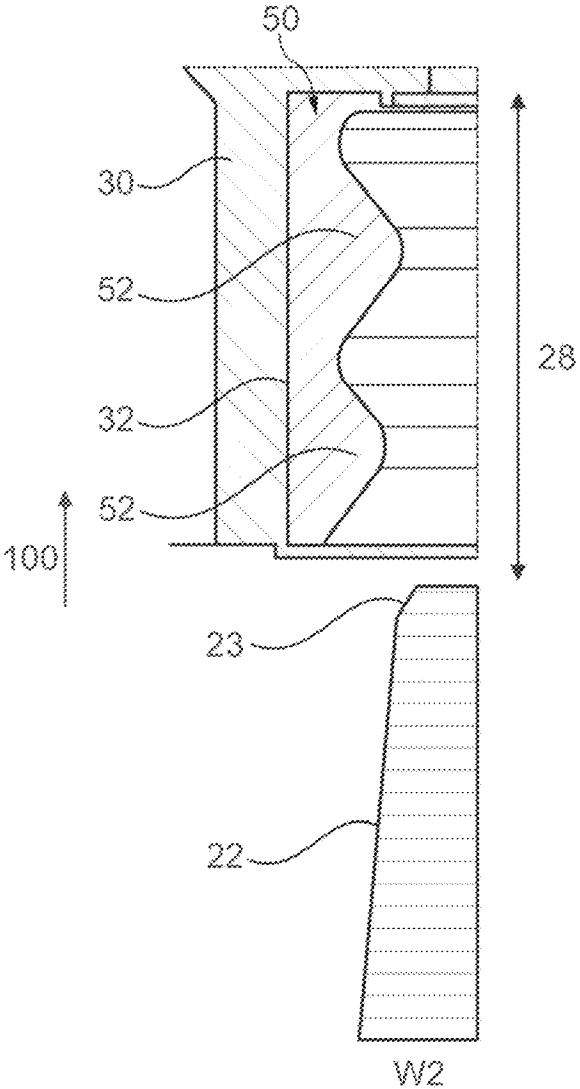

FIG. 10 shows compressible lips 52 of the flexible sealing element 50 during a displacement of a counter-connector 20 of an embodiment of a sealed electrical connector assembly 1 according to the present invention as shown in FIGS. 8 and 9. The progress of movement is depicted in FIG. 10A-10C, such that the counter-connector 20 moves along the mating direction 100 and travels across the counter-connector mating path distance 28 from FIG. 10A-10C. The flexible sealing element 50 is fixed to the connector housing 30. The slanted counter-connector sealing wall 22 decreases in width W2 along the mating direction 100, which is illustrated by an angle $\alpha$ in FIG. 10C, with respect to the mating direction 100, which is the vertical direction. The slanted counter-connector sealing wall 22 includes a lead-in chamfer 23, which is slanted to facilitate a lead-in of the flexible sealing element 50. FIG. 10A shows the situation before the counter-connector 20 contacts the flexible sealing element 50. FIG. 10B shows the situation when the lower compressible lip of the compressible lips 52 is in slight contact with the slanted counter-connector sealing wall 22. FIG. 10C shows the counter-connector 20 in a final and fully sealed position, wherein the flexible sealing element 50 is compressed in the sealing region 40 between the counter-connector sealing wall 22 and connector housing sealing wall 32. A respective compressive sealing reaction force is maximum in this position. The configuration essentially corresponds to the configuration of the first embodiment of the present invention depicted for instance in FIGS. 3A-3E and similar reaction force behavior can be obtained such that no significant force peaks are provided by the engagement between the flexible sealing element 50 and the counter-connector sealing wall 22 when the counter-connector 20 is moved into the sealed position. The overall force level is relatively low, since the compressible lips 52 are accordingly formed to fit the slanted counter-connector sealing wall 22. The compressible lips are not compressed to the maximum in the beginning of the movement. The main contact pressure is applied at the last third of the counter-connector movement.

LISTING OF REFERENCE NUMBERS

1 sealed electrical connector assembly
10 second connector member
12 cable
20 first connector member
22 first connector member sealing wall
23 lead-in chamfer
24 force feedback element
26 bulge
27 latching protrusion
28 first connector member closing path distance
30 second connector member housing
32 second connector member sealing wall
34 force feedback counter-element
36 contact head
38 contact portion
40 sealing region
50 flexible sealing element
52 compressible lips
60 counter-connector
100 first direction α angle of the slanted sealing wall
W1 maximum protruding width of the bulge
W2 width of the sealing wall
F1 compressive sealing reaction force
F2 CPA member closing reaction force
F3 resulting reaction force

The invention claimed is:

1. A sealed electrical connector assembly, comprising:

a first connector member and a second connector member, wherein the first connector member is configured to be arrangeable in an open position and a sealed position, wherein, in the sealed position, the first connector member is fully mated and sealed with the second connector member, wherein the first connector member comprises a first connector member sealing wall extending essentially in a first direction, and wherein the second connector member comprises a second connector member sealing wall extending essentially in the first direction, wherein the first connector member further comprises at least one force feedback element, wherein the second connector member comprises a second connector member housing having at least one force feedback counter element configured to engage the at least one force feedback element when moving the first connector member towards the sealed position, wherein the at least one force feedback element of the first connector member is a rigid member extending in the first direction having a bulge provided at a central portion of the rigid member, wherein the bulge protrudes towards the at least one force feedback counter element, wherein the at least one force feedback counter element is a flexible locking member extending against the first direction and comprising a contact head arranged at a distal end of the flexible locking member and protruding towards the at least one force feedback element, and wherein an engagement between the at least one force feedback element and the at least one force feedback counter element is formed such that a force feedback can be provided to a user when the first connector member is moved to the sealed position; and a flexible sealing element, wherein, in the sealed position, the flexible sealing element is configured to be arranged between and contacting the first connector member sealing wall and the second connector member sealing wall in the sealing region, wherein the first connector sealing wall for releasably engaging the flexible sealing element is slanted with respect to the first direction along an entire sealing region, wherein the flexible sealing element is fixed with respect to the second connector member sealing wall and configured to be releasably engageable with the first connector member sealing wall for providing a watertight seal.

2. The sealed electrical connector assembly according to claim 1, wherein the flexible sealing element comprises at least two compressible lips extending towards the slanted first connector member sealing wall and wherein the at least two compressible lips are configured such that a compression of the at least two compressible lips is essentially the same in the sealed position.

3. The sealed electrical connector assembly according to claim 1, wherein an angle of the slanted first connector member sealing wall is within a range of 1° to 20°.

4. The sealed electrical connector assembly according to claim 1, wherein the flexible sealing element is fixed with respect to the second connector member sealing wall and configured to be releasably engageable with the first connector member sealing wall.

5. The sealed electrical connector assembly according to claim 1, wherein the contact between the flexible sealing element and the slanted first connector member sealing wall is formed such that a compressive sealing reaction force against the first direction is essentially constantly increasing when first connector member is moved from the open to the sealed position.

6. The sealed electrical connector assembly according to claim 1, wherein the first connector member is configured to be moveable about a first connector member closing path distance from the open position to the sealed position and wherein the at least one force feedback element and the at least one force feedback counter element are formed to allow that, in the last 10% of a first connector member closing path distance of the first connector member, a resulting reaction force acting on the first connector member becomes minimum.

7. The sealed electrical connector assembly according to claim 6, wherein the first connector member closing path distance of the first connector member from the open position towards the sealed position is up to 20 mm.

8. The sealed electrical connector assembly according to claim 1, wherein when the first connector member is moved from the open to the sealed position in the first direction, the flexible locking member is configured to:

a. initially engage the bulge of the rigid member with the contact head at a contact portion,
b. deflect due to the engagement with the bulge while the movement continues, and
c. flexibly return to an initial position of the flexible locking member after the contact portion has passed a maximum protruding width of the bulge, wherein the deflected contact head urges the bulge in the first direction towards the sealed position.

9. The sealed electrical connector assembly according to claim 8, wherein the electrical connector assembly is configured to provide a haptic feedback to a user pushing the first connector member towards the sealed position when the first connector member has reached the sealed position.

10. The sealed electrical connector assembly according to claim 8, wherein one of the connector members is a plug connector.

11. The sealed electrical connector assembly according to claim 8, wherein an engagement between the first connector member, the flexible sealing element and the second connector member housing is formed such that a resulting reaction force acting on the first connector member, when the first connector member is moved from the open position to the sealed position along a first direction:

a. assumes positive values in a beginning of the first connector member movement such that the resulting reaction force acts in a direction against the first direction,
b. continuously increases until the resulting reaction force reaches a single maximum value, and then
c. continuously decreases until the resulting reaction force assumes a minimum value in the sealed position.

12. The sealed electrical connector assembly according to claim 1, wherein the first connector member sealing wall for releasably engaging the flexible sealing element is slanted with respect to the first direction along the entire sealing region such that width of the first connector member sealing wall for releasably engaging the flexible sealing element continuously decreases along the first direction.

13. The sealed electrical connector assembly according to claim 1, wherein the first connector member is a connector position assurance (CPA) member and wherein the second connector member is a plug connector and wherein the first direction is a CPA member closing direction.

14. The sealed electrical connector assembly according to claim 1, wherein the first connector member is a counter-connector and wherein the second connector member is a corresponding plug connector and wherein the first direction is a connector assembly mating direction.

15. A method for coupling an electrical connector assembly, comprising:

providing a sealed electrical connector assembly having a first connector member and a second connector member, wherein the first connector member is configured to be arrangeable in an open position and a sealed position, wherein, in the sealed position, the first connector member is fully mated and sealed with the second connector member, wherein the first connector member comprises a first connector member sealing wall extending essentially in a first direction, and wherein the second connector member comprises a second connector member sealing wall extending essentially in the first direction, wherein the first connector member further comprises at least one force feedback element, wherein the second connector member comprises a second connector member housing having at least one force feedback counter element configured to engage the at least one force feedback element when moving the first connector member towards the sealed position, wherein the at least one force feedback element of the first connector member is a rigid member extending in the first direction having a bulge provided at a central portion of the rigid member, wherein the bulge protrudes towards the at least one force feedback counter element, wherein the at least one force feedback counter element is a flexible locking member extending against the first direction and comprising a contact head arranged at a distal end of the flexible locking member and protruding towards the at least one force feedback element, and wherein an engagement between the at least one force feedback element and the at least one force feedback counter element is formed such that a force feedback can be provided to a user when the first connector member is moved to the sealed position, wherein the sealed electrical connector assembly also has a flexible sealing element, wherein, in the sealed position, the flexible sealing element is configured to be arranged between and contacting the first connector member sealing wall and the second connector member sealing wall in the sealing region, wherein the first connector sealing wall for releasably engaging the flexible sealing element is slanted with respect to the first direction along an entire sealing region, wherein the flexible sealing element is fixed with respect to the second connector member sealing wall and configured to be releasably engageable with the first connector member sealing wall for providing a watertight seal; and moving the first connector member from the open to the sealed position for providing an electrical connection and a watertight seal.

16. A sealed electrical connector assembly, comprising:

a first connector member and a second connector member, wherein the first connector member is configured to be arrangeable in an open position and a sealed position, wherein, in the sealed position, the first connector member is fully mated and sealed with the second connector member, wherein the first connector member comprises a first connector member sealing wall extending essentially in a first direction, wherein the second connector member comprises a second connector member sealing wall extending essentially in the first direction, wherein the first connector member further comprises at least one force feedback element, wherein the second connector member comprises a second connector member housing having at least one force feedback counter element configured to engage the at least one force feedback element when moving the first connector member towards the sealed position, wherein the at least one force feedback element of the first connector member is a rigid member extending in the first direction having a bulge provided at a central portion of the rigid member, wherein the bulge protrudes towards the at least one force feedback counter element, wherein the at least one force feedback counter element is a flexible locking member extending against the first direction and comprising a contact head arranged at a distal end of the flexible locking member and protruding towards the at least one force feedback element, and wherein an engagement between the at least one force feedback element and the at least one force feedback counter element is formed such that a force feedback can be provided to a user when the first connector member is moved to the sealed position; and a means for providing a watertight seal between the first connector member to the second connector member, wherein the means is arranged between the sealing walls of the first connector member and the second connector member in the sealing region, wherein the means is fixed with respect to one of the sealing walls and is releasably engageable with another one of the sealing walls.

* * * * *